US012297029B2

(12) United States Patent
Sanger

(10) Patent No.: US 12,297,029 B2
(45) Date of Patent: May 13, 2025

(54) DUNNAGE ARRANGEMENT INCLUDING CARGO POUCHES WITH STAGGERED SUPPORT MEMBERS

(71) Applicant: Bradford Company, Holland, MI (US)

(72) Inventor: Matthew Scott Sanger, Ferndale, MI (US)

(73) Assignee: Bradford Company, Holland, MI (US)

( * ) Notice: Subject to any disclaimer, the term of this patent is extended or adjusted under 35 U.S.C. 154(b) by 108 days.

(21) Appl. No.: 18/328,406

(22) Filed: Jun. 2, 2023

(65) Prior Publication Data

US 2023/0391533 A1 Dec. 7, 2023

Related U.S. Application Data

(60) Provisional application No. 63/349,251, filed on Jun. 6, 2022.

(51) Int. Cl.
*B65D 81/05* (2006.01)

(52) U.S. Cl.
CPC ..... *B65D 81/05* (2013.01)

(58) Field of Classification Search
CPC ..... B65D 19/44; B65D 19/02; B65D 90/12; B65D 2519/00532; B65D 2519/0082; B65D 2585/6882; B65D 25/005; B65D 88/12; B65D 81/05
USPC ..... 206/216
See application file for complete search history.

(56) References Cited

U.S. PATENT DOCUMENTS

| | | | | |
|---|---|---|---|---|
| 4,527,694 | A * | 7/1985 | Bolt | B42F 15/0094 211/162 |
| 6,830,156 | B2 * | 12/2004 | MacKelvie | G11B 33/0422 211/40 |
| 8,308,015 | B2 * | 11/2012 | Bradford | B65D 81/05 220/495.01 |
| 9,016,507 | B2 * | 4/2015 | Bradford | B65D 88/546 220/544 |
| 9,422,081 | B2 * | 8/2016 | Bublitz | B65D 85/68 |
| 9,434,510 | B2 * | 9/2016 | Sanger | B65D 19/44 |
| 9,969,528 | B2 * | 5/2018 | Sanger | B65D 88/12 |
| 10,604,333 | B2 * | 3/2020 | Bradford | B65D 85/68 |
| 10,604,334 | B2 * | 3/2020 | Bradford | B65D 19/18 |
| 2003/0168461 | A1 * | 9/2003 | Richardson | B65F 1/068 220/661 |
| 2015/0101956 | A1 * | 4/2015 | Dobrinski | B65D 90/12 206/591 |

(Continued)

*Primary Examiner* — Chun Hoi Cheung
(74) *Attorney, Agent, or Firm* — Barnes & Thornburg LLP

(57) ABSTRACT

A dunnage arrangement includes a container having spaced-apart sidewalls extending upwardly from the container floor, first and second pairs of guide rails each mounted to and extending at least partially along the length respective sidewalls such that the second pair of guide rails are positioned between the floor and the first pair of guide rails, a plurality of pouches each having first and second opposed sidewalls defining a pocket therebetween configured to support cargo within the container, and support members coupled to or near terminal tops of each of the first and second sidewalls of the pouches. The pouches are received side-by-side within the container with the support members coupled to the first sidewalls supported on and movable along the first pair of guide rails and with the support members coupled to the second sidewalls supported on and movable along the second pair of guide rails.

20 Claims, 8 Drawing Sheets

(56) References Cited

U.S. PATENT DOCUMENTS

| | | | | |
|---|---|---|---|---|
| 2015/0136643 | A1* | 5/2015 | Bradford | B65D 19/06<br>206/583 |
| 2015/0259136 | A1* | 9/2015 | Sanger | B65B 43/00<br>206/521 |

* cited by examiner

DUNNAGE ARRANGEMENT INCLUDING CARGO POUCHES WITH STAGGERED SUPPORT MEMBERS

CROSS-REFERENCE TO RELATED APPLICATION

This patent application claims the benefit of, and priority to, U.S. Provisional Patent Application Ser. No. 63/349,251, filed Jun. 6, 2022, the disclosure of which is expressly incorporated herein by reference in its entirety.

FIELD OF THE INVENTION

The present invention relates generally to shipping and/or storage containers, and more specifically to such containers with movable pouches for supporting cargo therein.

BACKGROUND

Storage and/or shipping containers for storing and/or shipping cargo, e.g., in the form of multiple different products and/or multiple units of identical products, are typically available in various sizes and configurations. Dunnage for some such containers may take the form of multiple pouches movable relative to the container to load cargo therein and to remove cargo therefrom.

SUMMARY

The present invention may comprise one or more of the features recited in the attached claims, and/or one or more of the following features and combinations thereof. In a first aspect, a dunnage arrangement may comprise a container having spaced-apart sidewalls each defining a length and each extending upwardly from opposite respective sides of a floor of the container, a first pair of guide rails each mounted to and extending at least partially along the length of a respective one of the spaced-apart sidewalls of the container, a second pair of guide rails each mounted to and extending at least partially along the length of a respective one of the spaced-apart sidewalls such that the second pair of guide rails are positioned between the floor and the first pair of guide rails, a plurality of pouches each having first and second opposed sidewalls extending upwardly from a bottom wall or fold to define a pocket therebetween configured to support cargo within the container, and support members coupled to or near terminal tops of each of the first and second sidewalls of the plurality of pouches, wherein the pouches are received side-by-side within the container with the support members coupled to the first sidewalls supported on and movable along the first pair of guide rails and with the support members coupled to the second sidewalls supported on and movable along the second pair of guide rails.

A second aspect may include the features of the first aspect, and wherein the first pair of guide rails are aligned and parallel with one another with both of the first pair of guide rails disposed a first distance above the floor of the container, and wherein the second pair of guide rails are aligned and parallel with one another with both of the second pair of guide rails disposed a second distance above the floor of the container, the second distance less than the first distance by at least a thickness of the support members.

A third aspect may include the features of the second aspect, and wherein each of the first pair of guide rails and each of the second pair or guide rails comprises an elongated hollow member defining a channel extending at least partially along the length of a respective one of the spaced-apart sidewalls of the container, and wherein the support members each comprise at least one rod coupled to or near a terminal top of a respective one of the first and second sidewalls of the plurality of pouches and extending between the spaced-apart sidewalls of the container, and rollers attached to opposite ends of the at least one rod, the rollers disposed within and configured to roll or glide along the channels of a respective one of the first or second pair of guide rails.

A fourth aspect may include the features of the second aspect, and wherein each of the first pair of guide rails and each of the second pair or guide rails comprises an elongated hollow member defining a channel extending at least partially along the length of a respective one of the spaced-apart sidewalls of the container, and wherein the support members each comprise a pair of rollers attached to respective opposite sides a respective one of the first and second sidewalls of the plurality of pouches at or near a terminal top thereof, the rollers disposed within and configured to roll or glide along the channels of a respective one of the first or second pair of guide rails.

A fifth aspect may include the features of the second aspect, and wherein each of the first pair of guide rails and each of the second pair or guide rails comprises an elongated hollow member defining a channel extending at least partially along the length of a respective one of the spaced-apart sidewalls of the container, and wherein the support members each comprise at least one rod coupled to or near a terminal top of a respective one of the first and second sidewalls of the plurality of pouches and extending between the spaced-apart sidewalls of the container, the at least one rod having flared opposite ends disposed within and configured to glide along the channels of a respective one of the first or second pair of guide rails.

A sixth aspect may include the features of the second aspect, and wherein each of the first pair of guide rails and each of the second pair or guide rails comprises an elongated bracket defining a channel extending at least partially along the length of a respective one of the spaced-apart sidewalls of the container, and wherein the support members each comprise a pair of clips attached to respective opposite sides a respective one of the first and second sidewalls of the plurality of pouches at or near a terminal top thereof, each of the clips including an engagement member engaging the channels such that the clips slide or glide along the channels of a respective one of the first or second pair of guide rails.

A seventh aspect may include the features of the second aspect, and wherein each of the first pair of guide rails and each of the second pair or guide rails comprises an elongated tube extending at least partially along the length of a respective one of the spaced-apart sidewalls of the container, and wherein the support members each comprise a pair of rings attached to respective opposite sides a respective one of the first and second sidewalls of the plurality of pouches at or near a terminal top thereof, each of the rings received on a respective one of the first or second pair of guide rails such that the rings slide or glide along a respective pair of tubes.

An eighth aspect may include the features of the second aspect, and wherein the support members comprise a plurality of first support members each coupled to or near a terminal top of the first sidewall of a respective one of the plurality of pouches, and a plurality of second support members each coupled to or near a terminal top of the second sidewall of a respective one of the plurality of pouches.

A ninth aspect may include the features of the eighth aspect, and wherein each of the plurality of pouches has a folded configuration in which the first and second sidewalls of the pouch are adjacent to one another, the first support member is supported on the first pair of guide rails and the second support member is supported on the second pair of guide rails and positioned at least partially under the first support member, and wherein each of the plurality of pouches has an expanded configuration in which the support members of the respective first and second sidewalls are spaced apart from one another along the respective first and second pair of guide rails to allow cargo to be received in and withdrawn from the pocket.

In a tenth aspect, a dunnage arrangement may comprise a container having spaced-apart sidewalls each defining a length and each extending upwardly from opposite respective sides of a floor of the container, a first pair of guide rails each mounted to and extending at least partially along the length of a respective one of the spaced-apart sidewalls of the container, a second pair of guide rails each mounted to and extending at least partially along the length of a respective one of the spaced-apart sidewalls such that the second pair of guide rails are positioned between the floor and the first pair of guide rails, a plurality of pouches configured to be received side-by-side within the container, each having first and second opposed sidewalls extending upwardly from a bottom wall or fold to define a pocket therebetween configured to support cargo within the container, a plurality of first support members each coupled to or near a terminal top of the first sidewall of a respective one of the plurality of pouches, and a plurality of second support members each coupled to or near a terminal top of the second sidewall of a respective one of the plurality of pouches, wherein each of the plurality of pouches has a folded configuration in which the first and second sidewalls of the pouch are adjacent to one another, the first support member is supported on the first pair of guide rails and the second support member is supported on the second pair of guide rails and positioned at least partially under the first support member, and wherein each of the plurality of pouches has an expanded configuration in which the support members of the respective first and second sidewalls are spaced apart from one another along the respective first and second pair of guide rails to allow cargo to be received in and withdrawn from the pocket.

An eleventh aspect may include the features of the tenth aspect, and wherein the first pair of guide rails are aligned and parallel with one another with both of the first pair of guide rails disposed a first distance above the floor of the container, and wherein the second pair of guide rails are aligned and parallel with one another with both of the second pair of guide rails disposed a second distance above the floor of the container, the second distance less than the first distance by at least a thickness of the support members.

A twelfth aspect may include the features of the eleventh aspect, and wherein each of the first pair of guide rails and each of the second pair or guide rails comprises an elongated hollow member defining a channel extending at least partially along the length of a respective one of the spaced-apart sidewalls of the container, and wherein the plurality of first support members and the plurality of second support members each comprise at least one rod coupled to or near a terminal top of a respective one of the first and second sidewalls of the plurality of pouches and extending between the spaced-apart sidewalls of the container, and rollers attached to opposite ends of the at least one rod, the rollers disposed within and configured to roll or glide along the channels of a respective one of the first or second pair of guide rails.

A thirteenth aspect may include the features of the eleventh aspect, wherein each of the first pair of guide rails and each of the second pair or guide rails comprises an elongated hollow member defining a channel extending at least partially along the length of a respective one of the spaced-apart sidewalls of the container, and wherein the plurality of first support members and the plurality of second support members each comprise a pair of rollers attached to respective opposite sides a respective one of the first and second sidewalls of the plurality of pouches at or near a terminal top thereof, the rollers disposed within and configured to roll or glide along the channels of a respective one of the first or second pair of guide rails.

A fourteenth aspect may include the features of the eleventh aspect, and wherein each of the first pair of guide rails and each of the second pair or guide rails comprises an elongated hollow member defining a channel extending at least partially along the length of a respective one of the spaced-apart sidewalls of the container, and wherein the plurality of first support members and the plurality of second support members each comprise at least one rod coupled to or near a terminal top of a respective one of the first and second sidewalls of the plurality of pouches and extending between the spaced-apart sidewalls of the container, the at least one rod having flared opposite ends disposed within and configured to glide along the channels of a respective one of the first or second pair of guide rails.

A fifteenth aspect may include the features of the eleventh aspect, and wherein each of the first pair of guide rails and each of the second pair or guide rails comprises an elongated bracket defining a channel extending at least partially along the length of a respective one of the spaced-apart sidewalls of the container, and wherein the plurality of first support members and the plurality of second support members each comprise a pair of clips attached to respective opposite sides a respective one of the first and second sidewalls of the plurality of pouches at or near a terminal top thereof, each of the clips including an engagement member engaging the channels such that the clips slide or glide along the channels of a respective one of the first or second pair of guide rails.

A sixteenth aspect may include the features of the eleventh aspect, and wherein each of the first pair of guide rails and each of the second pair or guide rails comprises an elongated tube extending at least partially along the length of a respective one of the spaced-apart sidewalls of the container, and wherein the plurality of first support members and the plurality of second support members each comprise a pair of rings attached to respective opposite sides a respective one of the first and second sidewalls of the plurality of pouches at or near a terminal top thereof, each of the rings received on a respective one of the first or second pair of guide rails such that the rings slide or glide along a respective pair of tubes.

In a seventeenth aspect, a dunnage arrangement may comprise a container having spaced-apart sidewalls each defining a length and each extending upwardly from opposite respective sides of a floor of the container, a first pair of guide rails each mounted to and extending at least partially along the length of a respective one of the spaced-apart sidewalls of the container, a second pair of guide rails each mounted to and extending at least partially along the length of a respective one of the spaced-apart sidewalls such that the second pair of guide rails are positioned between the floor and the first pair of guide rails, a plurality of pouches configured to be received side-by-side within the container, each having first and second opposed sidewalls extending upwardly from a bottom wall or fold to define a pocket therebetween for supporting cargo within the container, and support members, coupled to the plurality of pouches, supported on and movable along each of the first and second pairs of guide rails, wherein the first sidewall of each of the plurality of pouches defines a first length between the bottom wall or fold and a respective one of the support members coupled thereto and supported on the first pair of guide rails, and wherein the second sidewall of each of the plurality of pouches defines a second length between the bottom wall or fold and a respective one of the support members coupled thereto and supported on the second pair of guide rails, the second length less than the first length.

An eighteenth aspect may include the features of the seventeenth aspect, and wherein the first pair of guide rails are aligned and parallel with one another with both of the first pair of guide rails disposed a first distance above the floor of the container, and wherein the second pair of guide rails are aligned and parallel with one another with both of the second pair of guide rails disposed a second distance above the floor of the container, the second distance and the second length less than the first distance and the first length respectively by at least a thickness of the support members.

A nineteenth aspect may include the features of the eighteenth aspect, and wherein the support members may comprise a plurality of first support members each coupled to or near a terminal top of the first sidewall of a respective one of the plurality of pouches, and a plurality of second support members each coupled to or near a terminal top of the second sidewall of a respective one of the plurality of pouches.

A twentieth aspect may include the features of the nineteenth aspect, and wherein each of the plurality of pouches has a folded configuration in which the first and second sidewalls of the pouch are adjacent to one another, the first support member is supported on the first pair of guide rails and the second support member is supported on the second pair of guide rails and positioned at least partially under the first support member, and wherein each of the plurality of pouches has an expanded configuration in which the support members of the respective first and second sidewalls are spaced apart from one another along the respective first and second pair of guide rails to allow cargo to be received in and withdrawn from the pocket.

BRIEF DESCRIPTION OF THE DRAWINGS

This disclosure is illustrated by way of example and not by way of limitation in the accompanying Figures. Where considered appropriate, reference labels have been repeated among the Figures to indicate corresponding or analogous elements.

DETAILED DESCRIPTION OF THE DRAWINGS

Figure 1:
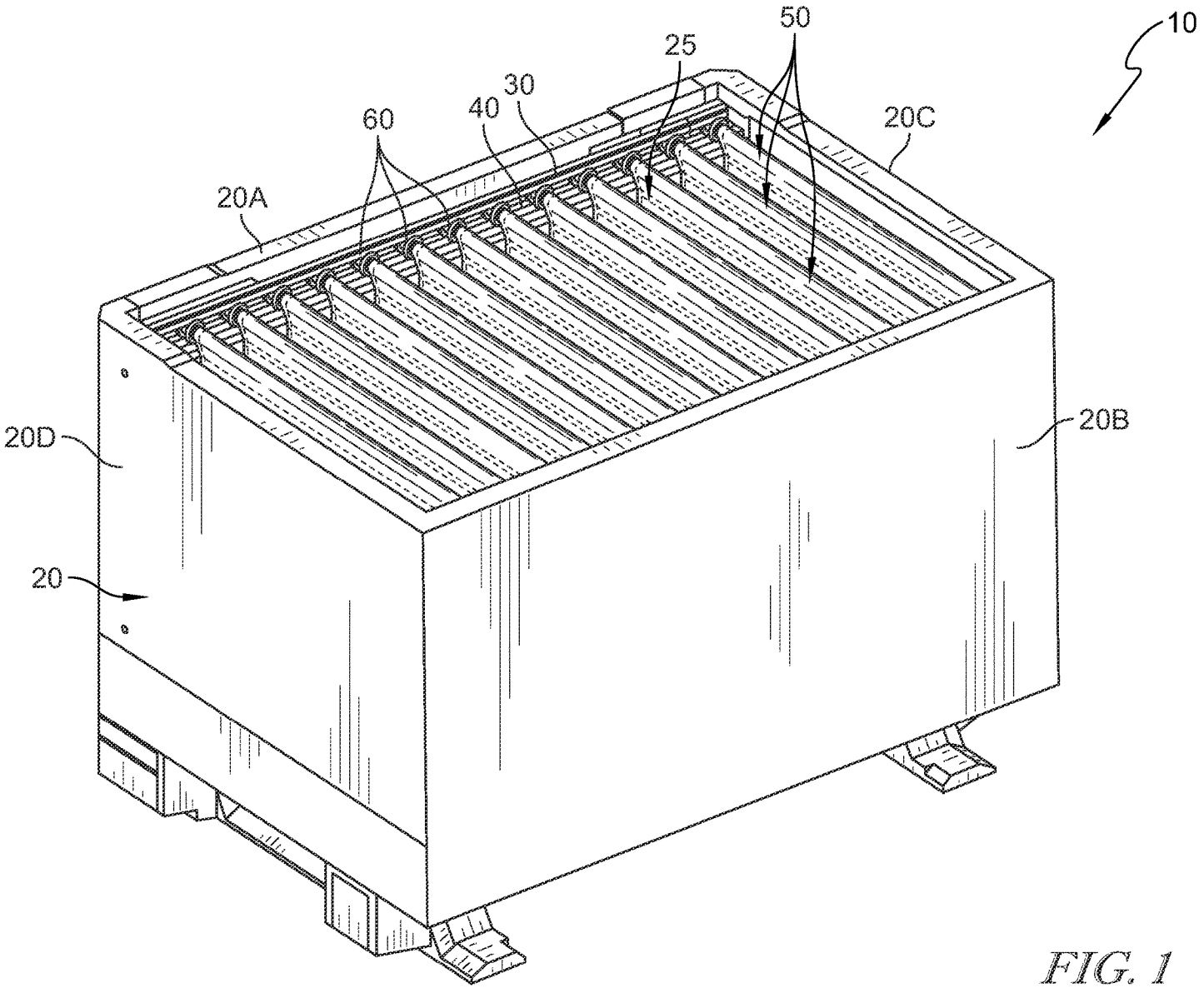
FIG. 1 is a side perspective view of an embodiment of a dunnage arrangement including a container with multiple movable cargo pouches having staggered support members.
Figure 2:
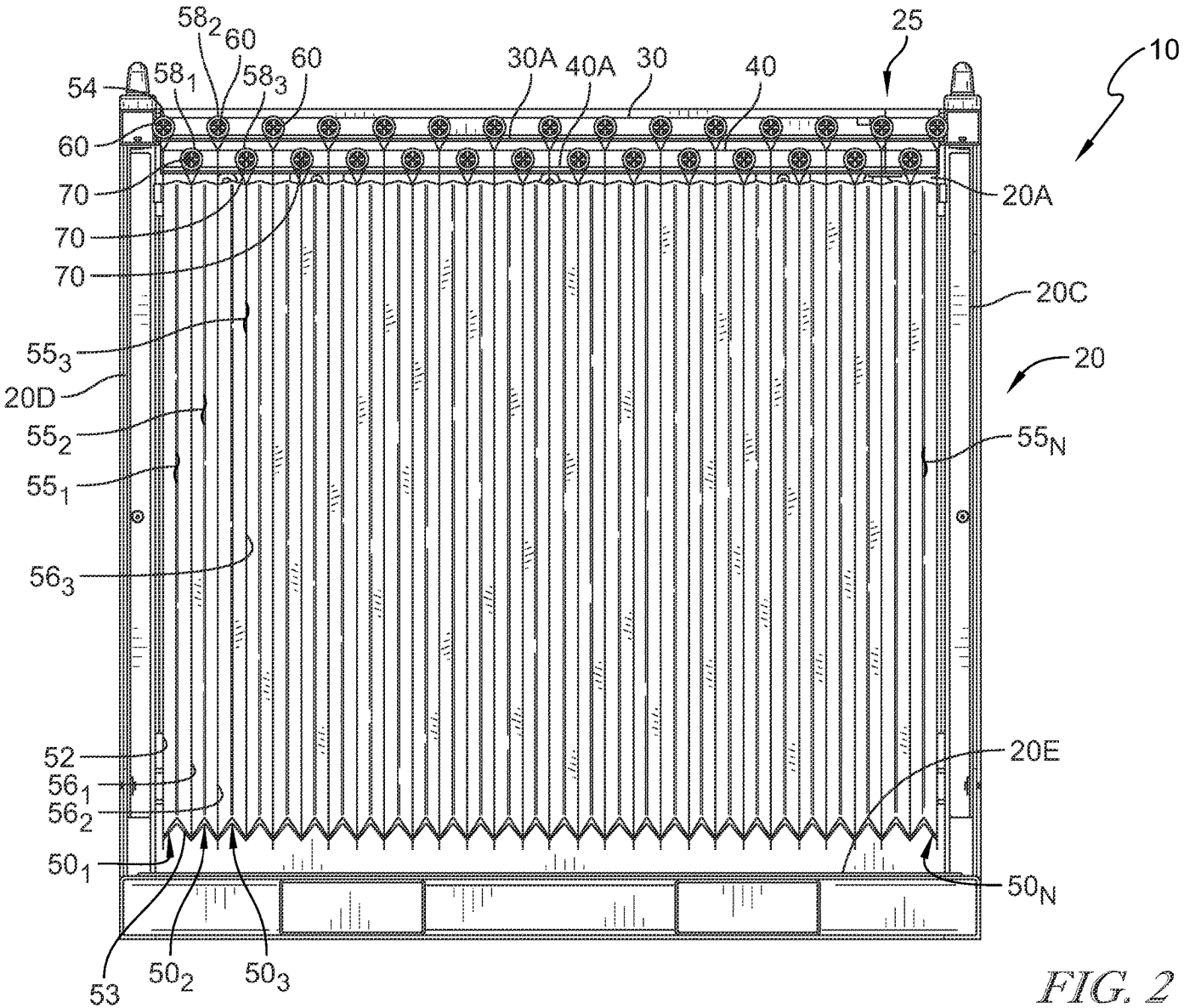
FIG. 2 is a side elevation view of the dunnage arrangement of claim 1 with one side of the container removed to illustrate mounting and support of the cargo pouches within the container.

While the concepts of the present disclosure are susceptible to various modifications and alternative forms, specific exemplary embodiments thereof have been shown by way of example in the drawing and will herein be described in detail. It should be understood, however, that there is no intent to limit the concepts of the present disclosure to the particular forms disclosed, but on the contrary, the intention is to cover all modifications, equivalents, and alternatives consistent with the present disclosure and the appended claims.

References in the specification to "one embodiment", "an embodiment", "an example embodiment", etc., indicate that the embodiment described may include a particular feature, structure, or characteristic, but every embodiment may not necessarily include the particular feature, structure, or characteristic. Moreover, such phrases may or may not necessarily refer to the same embodiment. Further, when a particular feature, structure, or characteristic is described in connection with an embodiment, it is submitted that it is within the knowledge of one skilled in the art to effect such feature, structure, or characteristic in connection with other embodiments whether or not explicitly described. Further still, it is contemplated that any single feature, structure, or characteristic disclosed herein may be combined with any one or more other disclosed feature, structure, or characteristic, whether or not explicitly described, and that no limitations on the types and/or number of such combinations should therefore be inferred.

This disclosure relates to a dunnage arrangement including a container fitted with upper and lower sets of support rails configured to support pouch support members of multiple, side-by-side cargo pouches movable along the support rails, wherein the cargo pouches are sized to each receive and support a cargo product therein, and wherein the pouches, support members and support rails are configured to provide for a compact configuration of empty ones of the cargo pouches in which the sides of the pouches are alternatingly mounted, via the pouch support members, to the upper and lower support rails so as to be successively staggered between the upper and lower support rails.

Referring now to FIGS. 1-5, an embodiment is shown of a dunnage arrangement 10 including a container 20 and cargo-supporting dunnage 25 mounted therein, wherein the cargo-supporting dunnage 25 is illustratively provided in the form of multiple cargo pouches 50 arranged side-by-side within the container 20. The container may be conventional, and illustratively includes opposed, spaced-apart sidewalls 20B each extending upwardly away from opposite sides of a floor 20E of the container 20 between opposed end walls 20C, 20D also extending upwardly and away from the floor 20E. Each of the sidewalls 20A, 20B illustratively defines a length between the end walls 20C, 20D. In the illustrated embodiment, the sidewalls 20A, 20B terminate at co-planar top surfaces, although in alternate embodiments the terminal top surface of the sidewall 20A may not be co-planar with the terminal top surface of the sidewall 20B. In some embodiments, the top surfaces of the end walls 20C, 20D may terminate at the terminal top surfaces of the sidewall(s) 20A and/or 20B as illustrated by example in FIG. 1. In alternate embodiments, one or both of the end walls 20C, 20D may terminate somewhere between the floor 20E and the terminal top surface(s) of the sidewall(s) 20A and/or 20B. In still other alternate embodiments, one or both of the end walls 20C, 20D may be hinged or otherwise configured to fold or drop to provide for an opening in the respective end(s) of the container 20 which has a terminal top surface positioned between the terminal top surface(s) of the sidewall(s) 20A, 20B and the floor of the container 20.

Upper and lower pairs of elongated support rails 30, 40 are illustratively mounted to the sidewalls 20A, 20B of the container 20 with one each of the support rails 40 mounted to one sidewall 20A and with one each of the support rails 30, 40 also mounted to the other sidewall 20B. One such set of support rails 30, 40 is illustrated in FIGS. 1-5 as being mounted to the sidewall 20A of the container 20, and it will be understood that another set of support rails 30, 40 are likewise mounted to the opposed sidewall 20B. The upper elongated support rail 30 is illustratively mounted, in a conventional manner, at or adjacent to the terminal top surface of the sidewall 20A, and illustratively extends along the length of the sidewall 20A. The support rail 30 is illustratively provided in the form of a single, unitary support rail, although in alternate embodiments, the support rail 30 may be made up of two or more sections mounted end-to-end. In the illustrated embodiment, the support rail 30 is mounted so as to form a support surface 30A that is parallel with a plane formed by the upwardly-facing surface of the floor 20E of the container 20 or that is parallel with a plane formed by a surface upon which the container 20 rests, and such that the pair of support rails 30 are aligned and parallel with one another. In alternate embodiments, the support rail 30 may be mounted such that the support surface 30A is non-parallel with the plane formed by the floor 20E of the container 20 and/or non-parallel with the surface upon which the container 20 rests.

The lower elongated support rail 40 is illustratively mounted, also in a conventional manner, below the support rail 30 such that the support rail 40 positioned between the floor 20E of the container 20 and the support rail 30, and illustratively extends along the length of the sidewall 20A. In the illustrated embodiment, the support rail 40 is mounted to the sidewall 20A such that a top surface of the support rail 40 is in contact with the a bottom surface of the support rail 30, although in alternate embodiments the support rails may be spaced apart from one other along the sidewall 20A. The support rail 40 is illustratively provided in the form of a single, unitary support rail, although in alternate embodiments, the support rail 40 may be made up of two or more sections mounted end-to-end. In the illustrated embodiment, the support rail 40 is mounted so as to form a support surface 40A that is parallel with the plane formed by the upwardly-facing surface of the floor 20E of the container 20 or that is parallel with a plane formed by a surface upon which the container 20 rests, and such that the pair of support rails 40 are aligned and parallel with one another. In alternate embodiments, the support rail 40 may be mounted such that the support surface 40A is non-parallel with the plane formed by the floor 20E of the container 20 and/or non-parallel with the surface upon which the container 20 rests. In any case, the support rail 40 is illustratively mounted such that the elongated support surface 40A of the support rail 40 is parallel with the elongated support surface 30A of the support rail 30. The pair of support rails 30 are illustratively mounted so as to be disposed a first distance above the floor 20E, and the pair of support rails 40 are illustratively mounted so as to be disposed a second distance above the floor, wherein the second distance is less than the first distance. In some embodiments, as described in greater detail below, the second distance is less than the first distance by at least the thickness of the support members supporting the cargo pouches 50 on the support rails 30, 40.

The multiple cargo pouches 50 are arranged side-by-side within the container 20 between the end walls 20C, 20D, and each pouch 50 is supported at opposite terminal sides thereof on and by the support rails 30, 40 mounted to each sidewall 20A, 20B of the container 20. Each cargo pouch 50 is illustratively provided in the form of a folded pouch having opposed sidewalls each extending upwardly from a bottom end or fold to define a pocket therebetween that is sized and configured to support a cargo product within the container 20. In the illustrated embodiment, the cargo pouches 50 are interconnected with each other such that each pouch 50 shares at least one sidewall with an adjacent pouch or pouches 50. For example, starting with the cargo pouch $\mathbf{50}_1$ positioned next to the end wall 20D in FIG. 2, one sidewall 52 extends upwardly from the bottom wall or fold 53 to a terminal top 54, and the other sidewall $\mathbf{56}_1$ extends upwardly from the bottom end or fold 53 to another terminal top $\mathbf{58}_1$. The sidewall $\mathbf{56}_1$ also forms one sidewall to the next successive pouch $\mathbf{50}_2$ which has another sidewall $\mathbf{56}_2$ extending upwardly from the fold of the pouch $\mathbf{50}_2$ to a terminal top $\mathbf{58}_2$, and the sidewall $\mathbf{56}_2$ also forms one sidewall to the next successive pouch $\mathbf{50}_3$ which has another sidewall $\mathbf{56}_3$ extending upwardly from the fold of the pouch $\mathbf{50}_3$ to a terminal top $\mathbf{58}_3$, etc. The container 20 illustratively includes N such pouches 50 arranged side-by-side, where N may be any positive integer which will depend on the dimensions of the container 20, so as to form a single tier of cargo pouches 50 supported by the opposed pairs of support rails 30, 40 within the container 20.

The sidewalls of the cargo pouches 50 illustratively alternate in length such that one sidewall, e.g., 52, $\mathbf{56}_2$ and all even-numbered subscripts of 56, of each pouch $\mathbf{50}_1$-$\mathbf{50}_N$ is supported at or adjacent to the terminal top thereof, e.g., 54, $\mathbf{58}_2$ and all even-numbered subscripts of 58, by a respective support member 60 on and movable along the support rail 30. The other sidewall, e.g. $\mathbf{56}_1$, $\mathbf{56}_3$ and all odd-numbered subscripts of 56, of each pouch $\mathbf{50}_1$-$\mathbf{50}_N$ is supported at or adjacent to the terminal top thereof, e.g., $\mathbf{58}_1$, $\mathbf{58}_3$ and all odd-numbered subscripts of 58), by a respective support member 70 on and movable along the lower support rail 40. The cargo pouches $\mathbf{50}_1$-$\mathbf{50}_N$ each form a corresponding cargo pocket $\mathbf{55}_1$-$\mathbf{55}_N$ between the respective sidewalls thereof and bottom end or fold 53. In alternate embodiments, one or more of the pouches $\mathbf{50}_1$-$\mathbf{50}_N$ may be separate from others of the pouches $\mathbf{50}_1$-$\mathbf{50}_N$. In any case, one of the sidewalls of each pouch 50 has a first length between the bottom end or fold 53 and the respective support member 60 and is movably coupled to the upper set of support rails 30, and the other sidewall of the pouch 50 has a second length between the bottom end or fold 53 and the respective support member 70, and is movably coupled to the lower set of support rails 40, wherein the second length is less than the first length.

Figure 3:
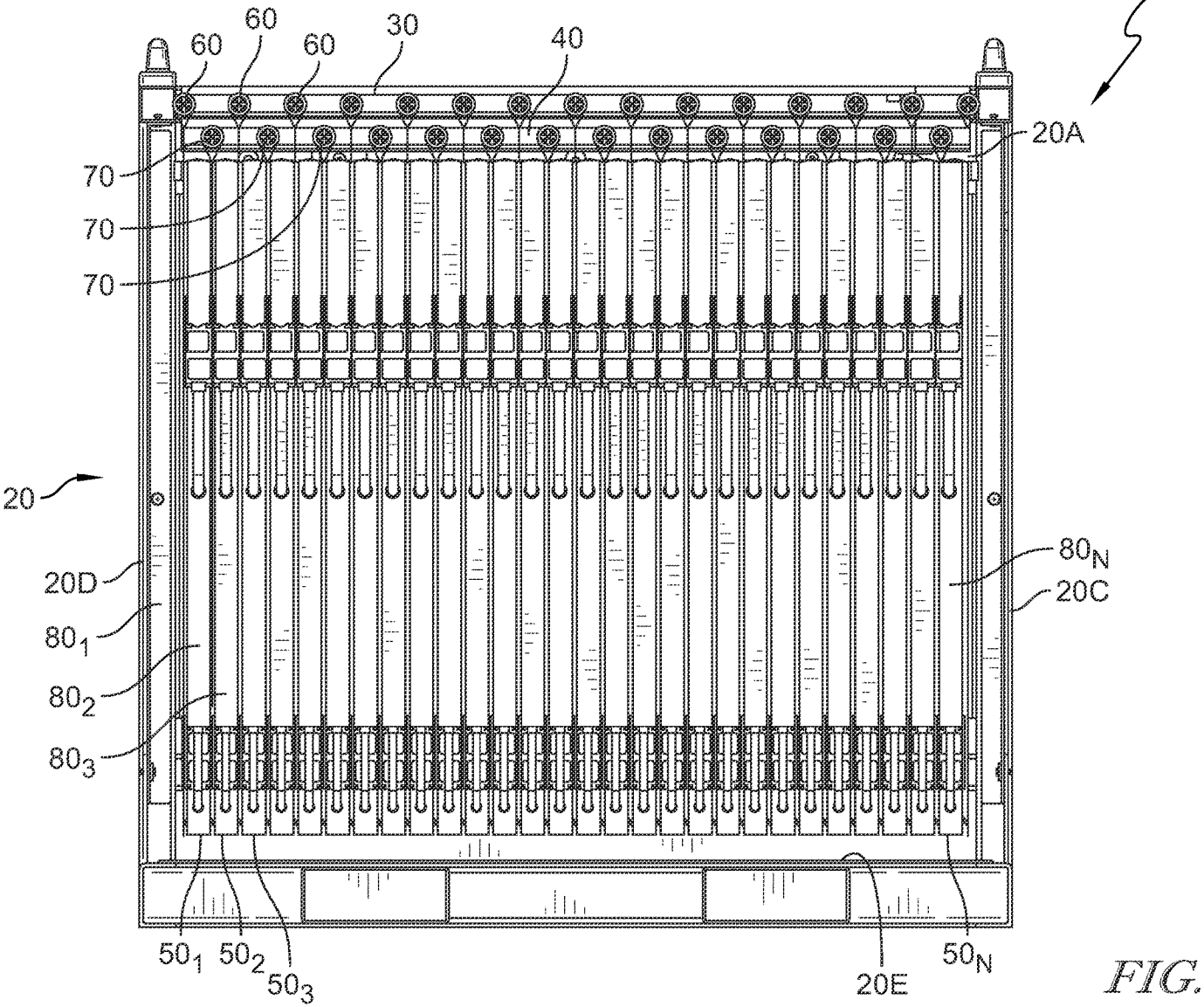
FIG. 3 is a side elevation view similar to FIG. 2 and illustrating a cargo product received in and supported by each of the multiple pouches.

The cargo pouches $\mathbf{50}_1$-$\mathbf{50}_N$ and the cargo pockets $\mathbf{55}_1$-$\mathbf{55}_N$ formed therein are illustratively sized to receive a respective cargo product $\mathbf{80}_1$-$\mathbf{80}_N$ therein as illustrated by example in FIG. 3. In some embodiments, the cargo products $\mathbf{80}_1$-$\mathbf{80}_N$ are identical to one another, although in other embodiments one or more of the cargo products $\mathbf{80}_1$-$\mathbf{80}_N$ may be different from others of the cargo products $\mathbf{80}_1$-$\mathbf{80}_N$. In any case, the dimensions of the cargo products $\mathbf{80}_1$-$\mathbf{80}_N$ may vary by application, and generally the dimensions of the cargo pouches $\mathbf{50}_1$-$\mathbf{50}_N$, the cargo pockets $\mathbf{55}_1$-$\mathbf{55}_N$ and the container 20, as well as the number of cargo pouches $\mathbf{50}_1$-$\mathbf{50}_N$ that can be fit into the container 20, may likewise vary by application.

With cargo products $\mathbf{80}_1$-$\mathbf{80}_N$ received within the cargo pouches $\mathbf{50}_1$-$\mathbf{50}_N$ as illustrated by example in FIG. 3, the support members 60 are spaced laterally apart from one another on and along the support rail 30, and the support members 70 are likewise spaced laterally apart from one other on and along the support rail 40. The support rails 30, 40 and the support members 60, 70 are illustratively configured such that the support members 60, 70 are moveable along and relative to the respective support rails 30, 40 while being suspended therefrom. In some embodiments, the support rails 30, 40 and the support members 60, 70 are configured such that the support members 60 and/or the support members 70 slide along and relative to the respective support rails 30, 40, although in other embodiments the support rails 30, 40 and the support members 60, 70 may be configured such that the support members 60 and/or the support members 70 roll along and relative to the respective support rails 30, Some non-limiting examples of the support rails 30, 40, the support members 60, 70 and the cargo pouches 50, are illustrated in FIGS. 6-9 and described below.

Figure 4A:
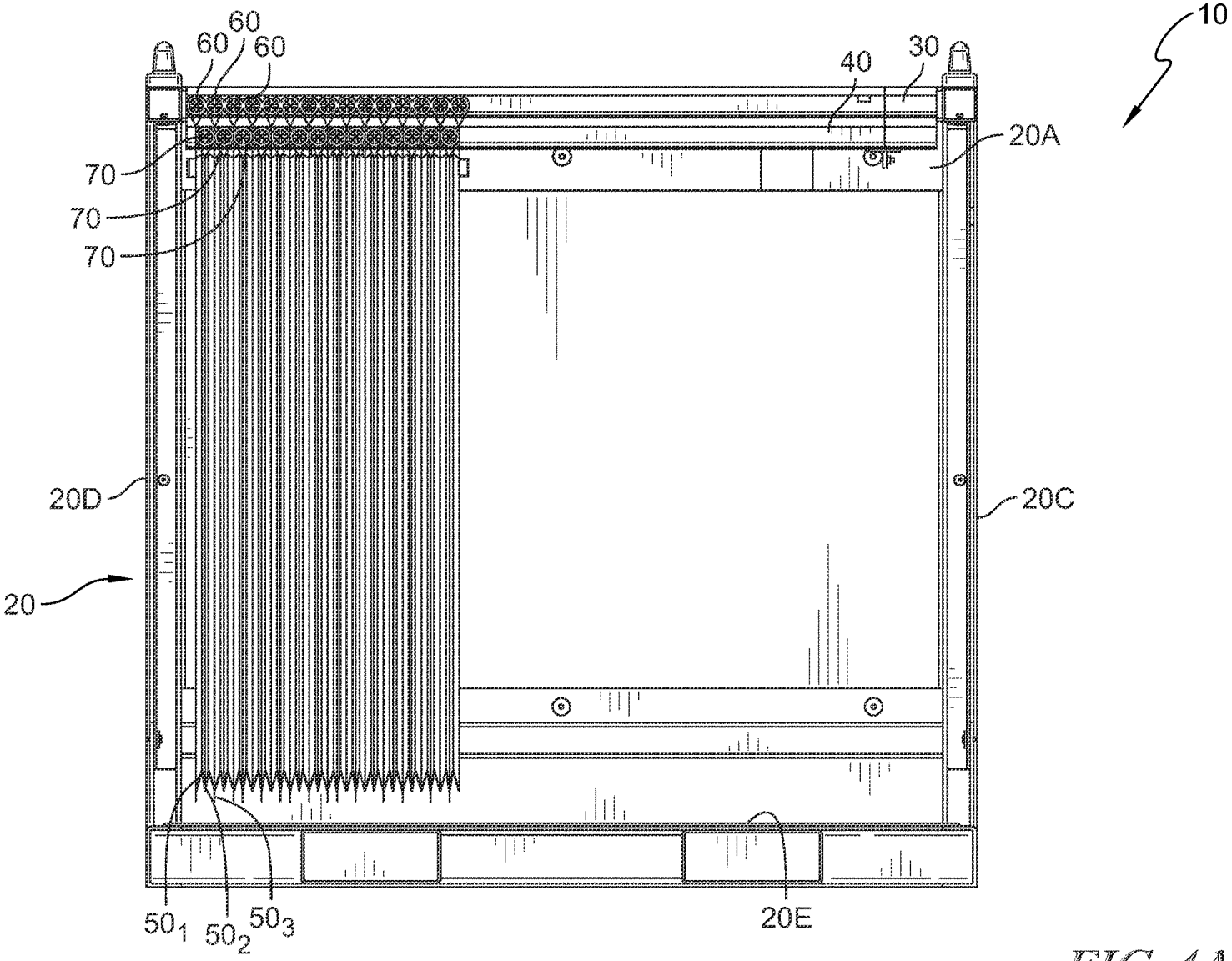
FIG. 4A is a side perspective view similar to FIGS. 2 and 3 and illustrating empty cargo pouches all moved to a compact configuration adjacent to one end wall of the container.
Figure 4B:
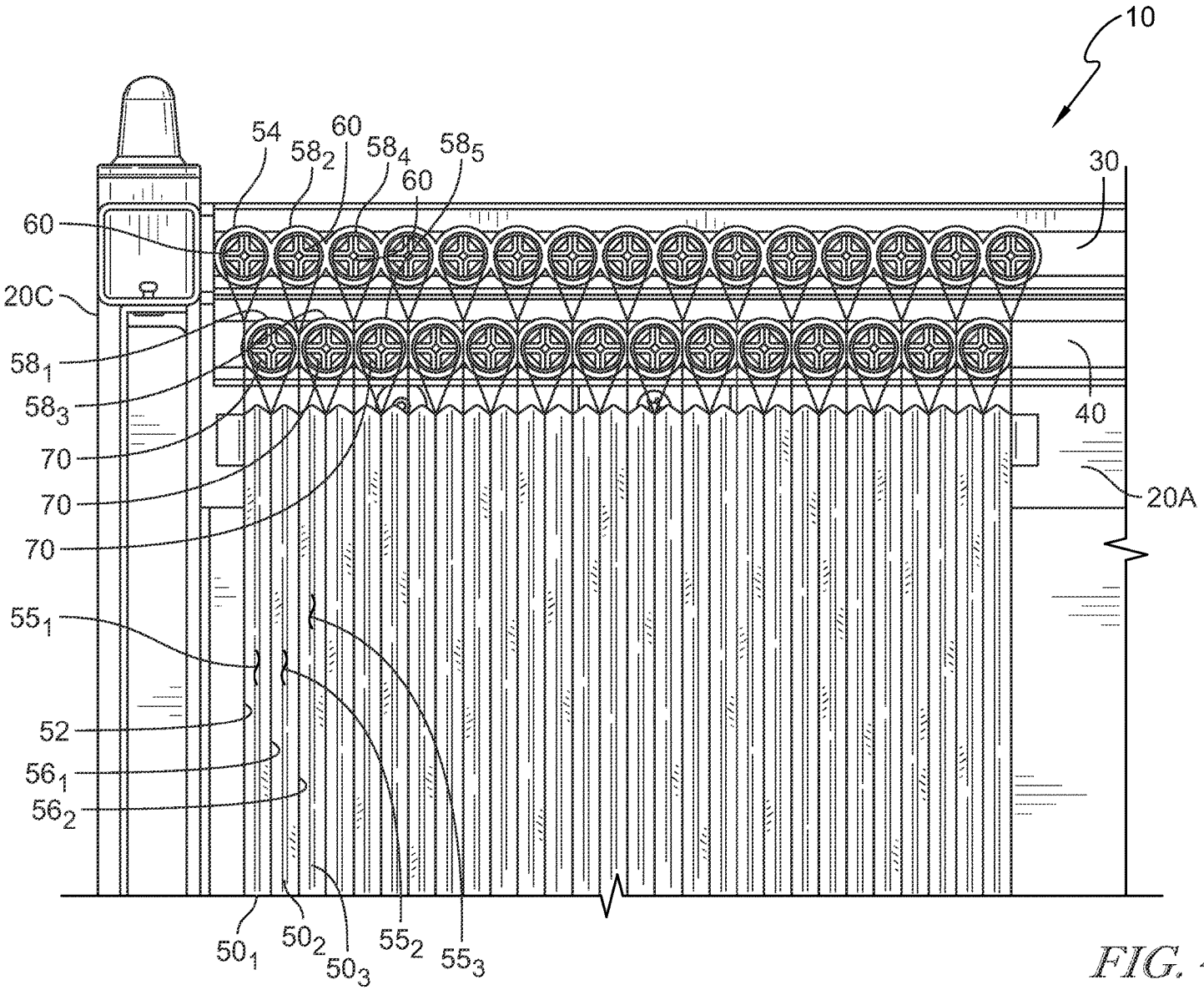
FIG. 4B is a magnified view of a portion of the view depicted in FIG. 4A and illustrating compact positioning of the cargo pouch support members in the compact configuration of the empty cargo pouches illustrated in FIG. 4A.

With all of the cargo pouches $\mathbf{50}_1$-$\mathbf{50}_N$ empty, the support members 60 can all be drawn together along the support rail 30 into sequential contact with one another, and the support members 70 can likewise all be drawn together along the support rail 40 into sequential contact with one another, to arrange each of the cargo pouches $\mathbf{50}_1$-$\mathbf{50}_N$ in a compact, folded configuration in which the sidewalls of each pouch $\mathbf{50}_1$-$\mathbf{50}_N$ are adjacent to one another as illustrated by example in FIGS. 4A and 4B. As best illustrated in FIG. 4B, with the support members 60, 70 illustratively identical to one another, each support member 70 is positioned on the support rail 40 below, e.g., centrally below, two adjacent support members 60 positioned on the support rail e.g., such that the support members 60, 70 sequentially interdigitate with one another along the respective support rails 30, 40 such that the support members 60 on the support rail 30 lie staggered or offset relative to the support members 70 on the support rail 40 and vice versa, and such that the support member 70 for each pouch $\mathbf{50}_1$-$\mathbf{50}_N$ is positioned at least partially under the support member 60 for the same pouch $\mathbf{50}_1$-$\mathbf{50}_N$. The lengths of the opposed sides of each pouch $\mathbf{50}_1$-$\mathbf{50}_N$, as well as the distances between the respective support rails 30 and 40 and the floor 20E of the container 20, thus illustratively differ by at least the thickness of the support members 70 so as to accommodate such staggering of the support members 60, 70 as illustrated by example in FIGS. 4A, 4B and 5. Each cargo pouch $\mathbf{50}_1$-$\mathbf{50}_N$ also has an expanded configuration in which the support members 60, 70 are spaced apart from one another along the respective support rails 30, 40 so as to allow cargo products $\mathbf{80}_1$-$\mathbf{80}_N$ to be received in and withdrawn from the pockets 55 of respective ones of the pouches $\mathbf{50}_1$-$\mathbf{50}_N$ as illustrated by example in FIGS. 3 and 5.

Figure 5:
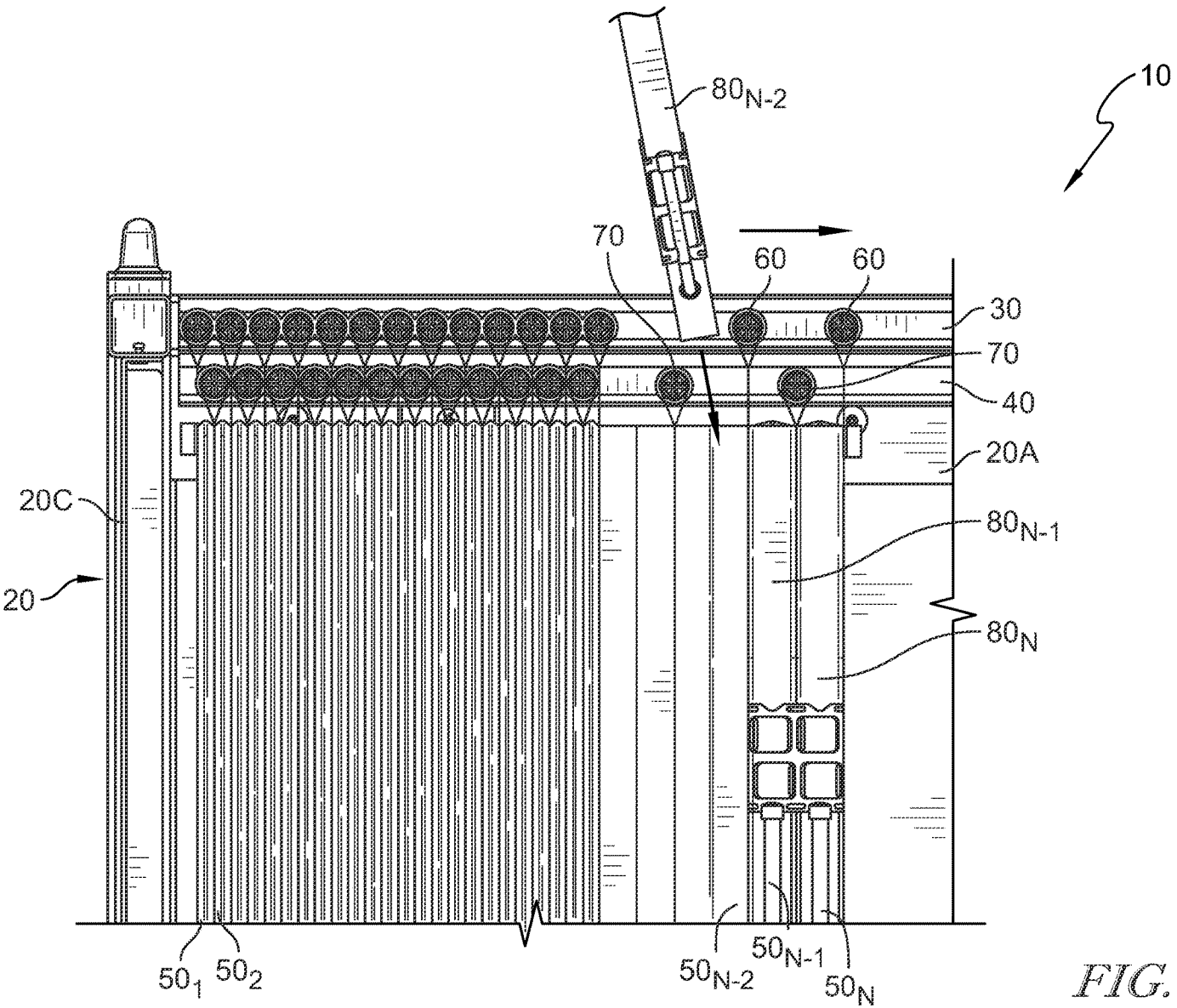
FIG. 5 is a side perspective view similar to FIG. 4B illustrating sequential loading of cargo products into the empty cargo pouches illustrated in FIG. 4B.

This arrangement of the support rails 30, 40 and respective support members 60, 70 thus provides for a space savings along the length of the container 20 (i.e., along the sidewalls 20A, 20B) of empty ones cargo pouches $\mathbf{50}_1$-$\mathbf{50}_N$ gathered together in the compact configuration illustrated by example in FIGS. 4A-5 of approximately 50% as compared with conventional cargo pouch arrangements in which the cargo pouch support members are all supported on and moveable along a single set of opposed support rails. This advantageously increases the number of cargo products $\mathbf{80}_1$-$\mathbf{80}_N$ in a container 20 that are accessible to a worker positioned at one end of the container 20, e.g., adjacent to the end wall 20C, by providing for a more compact gathering of empty ones of the cargo pouches $\mathbf{50}_1$-$\mathbf{50}_N$ at and adjacent to that end of the container, as best illustrated by example in FIG. 5. This, in turn, allows the worker positioned at one end of the container 20 to load and/or unload more of the cargo products $\mathbf{80}_1$-$\mathbf{80}_N$ into/from the cargo pouches $\mathbf{50}_1$-$\mathbf{50}_N$ as compared with conventional cargo pouch arrangements, due to the reduced length space that is taken up in the container 20 by the empty cargo pouches gathered at the respective end of the container 20. In other words, because the empty cargo pouches 50 collected at the respective end of the container 20 take up less length along the sidewalls 20A, 20B of the container 20 than the same number of cargo pouches in conventional cargo pouch arrangements, more cargo-bearing pouches $\mathbf{50}_1$-$\mathbf{50}_N$ will be reachable by the worker positioned at one end 20C, 20D of the container 20 than in conventional cargo pouch arrangements. In some embodiments, this may illustratively provide for an increased number of cargo pouches and cargo products per container 20, which may, in turn, reduce the total number of containers 20 required to transport/store the same number of cargo products as compared with conventional cargo pouch arrangements.

Figure 6:
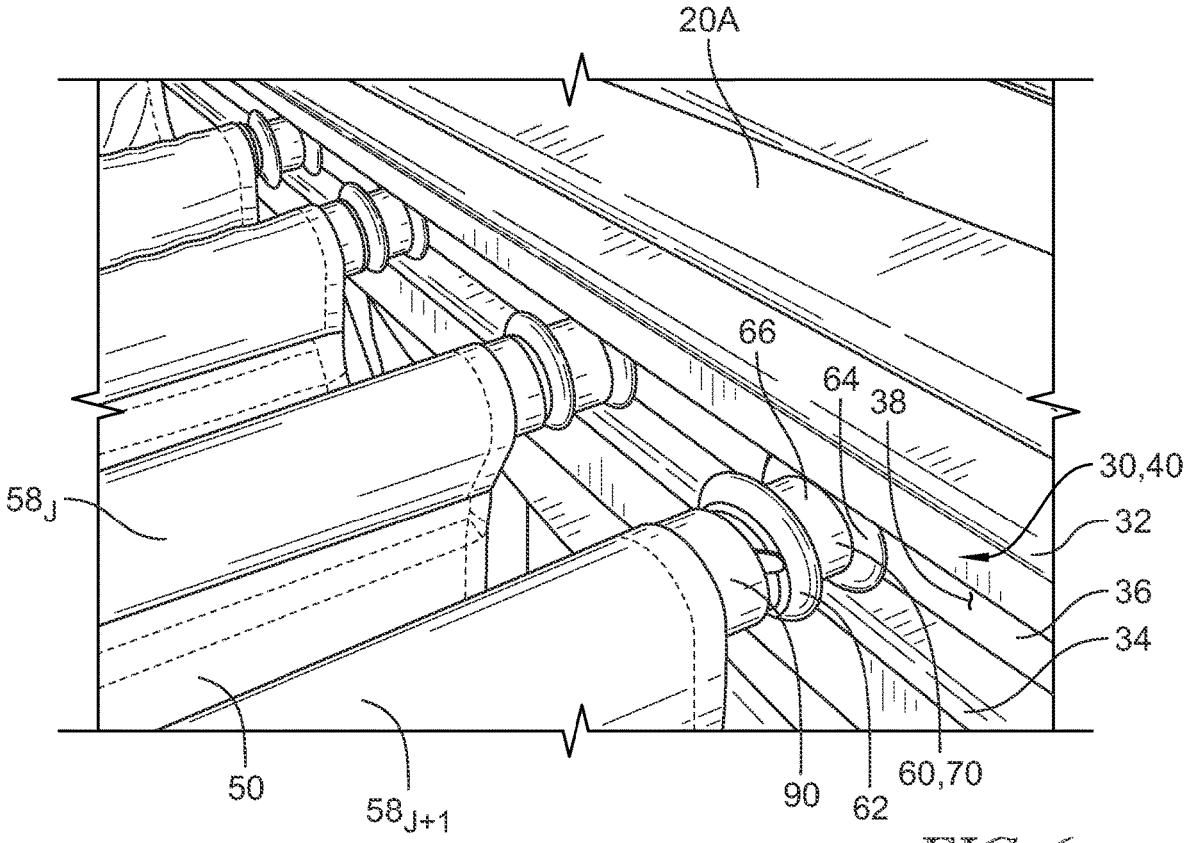
FIG. 6 is a magnified perspective view of an embodiment of the cargo pouches, support members, and cargo pouch support rails mounted to the container.

Referring now to FIG. 6, a non-limiting example is shown of an embodiment of one of the support rails 30, 40 and of one of the support members 60, illustrated and described above with respect to FIGS. 1-5. In the illustrated embodiment, the support rails 30, 40 (only one support rail shown in FIG. 6) are provided in the form of hollow, elongated structures having a C-shaped cross-section or variation thereof which includes spaced apart walls or flanges 32, 34 coupled to or integral with a three-sided body 36 of square or rectangular (or other) cross-section which together define a channel 38 therebetween. In the illustrated embodiment, the support members 60, 70 are illustratively provided in the form of rollers having raised end walls 62, 64 separated by a reduced cross-section support portion 66 extending between the end walls 62, 64. In some embodiments, the rollers 60, 70 are rotatable relative to the cargo pouches $\mathbf{50}_1$-$\mathbf{50}_N$ such that the rollers 60, 70 roll within the channel 38 along the flange 34 of the support rails 30, 40, although in alternate embodiments the rollers 60, 70 may be non-rotatable relative to the cargo pouches $\mathbf{50}_1$-$\mathbf{50}_N$ such that the rollers 60, 70 glide along the channel 38 of the support rails 30, 40. In the illustrated embodiment, the rollers 60, 70 are attached to opposite ends of a support rod 90 which is fed though an opening formed through or near the tops, e.g., $\mathbf{58}_J$, $\mathbf{58}_{J+1}$, of the cargo pouches $\mathbf{50}_1$-$\mathbf{50}_N$ and which extends between the sidewalls 20B of the container 20 as illustrated by example in FIGS. 1 and 6. In such embodiments, each of the cargo pouches $\mathbf{50}_1$-$\mathbf{50}_N$ is supported on a respective rod 90 passing through an opening formed in the top 58 of the respective pouch $\mathbf{50}_1$-$\mathbf{50}_N$ or otherwise attached to the top 58 of the respective pouch, and rollers 60, 70 are attached at and to opposite ends of the rod 90, and the rollers 60, 70 are inserted into the channels 38 of the respective support rails 30, 40 to arrange the cargo pouches $\mathbf{50}_1$-$\mathbf{50}_N$ within the container 20 as described above such that the cargo pouches $\mathbf{50}_1$-$\mathbf{50}_N$ are movable along and relative to the support rails 30, 40. In some alternate embodiments, the rods 90 may not extend fully across the pouches (e.g., short rods may extend only partially into each side of the pouches), and in other alternate embodiments the rods 90 may be omitted such that the rollers 60, 70 are attached or otherwise mounted directly to the sides of the pouches $\mathbf{50}_1$-$\mathbf{50}_N$ at or near the tops 58 thereof.

Figure 7:
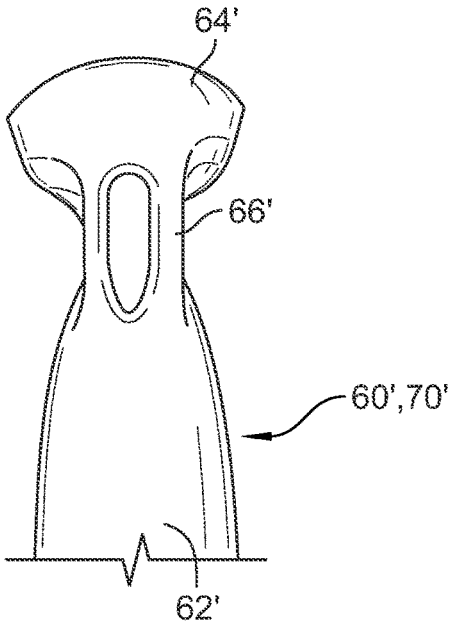
FIG. 7 is a magnified view of an alternate embodiment of a cargo pouch support member.

A non-limiting example of another support member 60', 70' configured to glide within the channel 38 of the support rails 30, 40 is illustrated by example in FIG. 7. In the embodiment illustrated in FIG. 7, the support member 60', 70' has a mounting end 62' configured to be mounted or otherwise attached to a rod, e.g., as illustrated in FIG. 6 and described above, or directly to an end of a pouch $\mathbf{50}_1$-$\mathbf{50}_N$ at or near the top 58 thereof, a flared end 64' and a pinched section 66' extending therebetween and having a reduced cross-sectional area relative to the ends 62', 64'.

Figure 8:
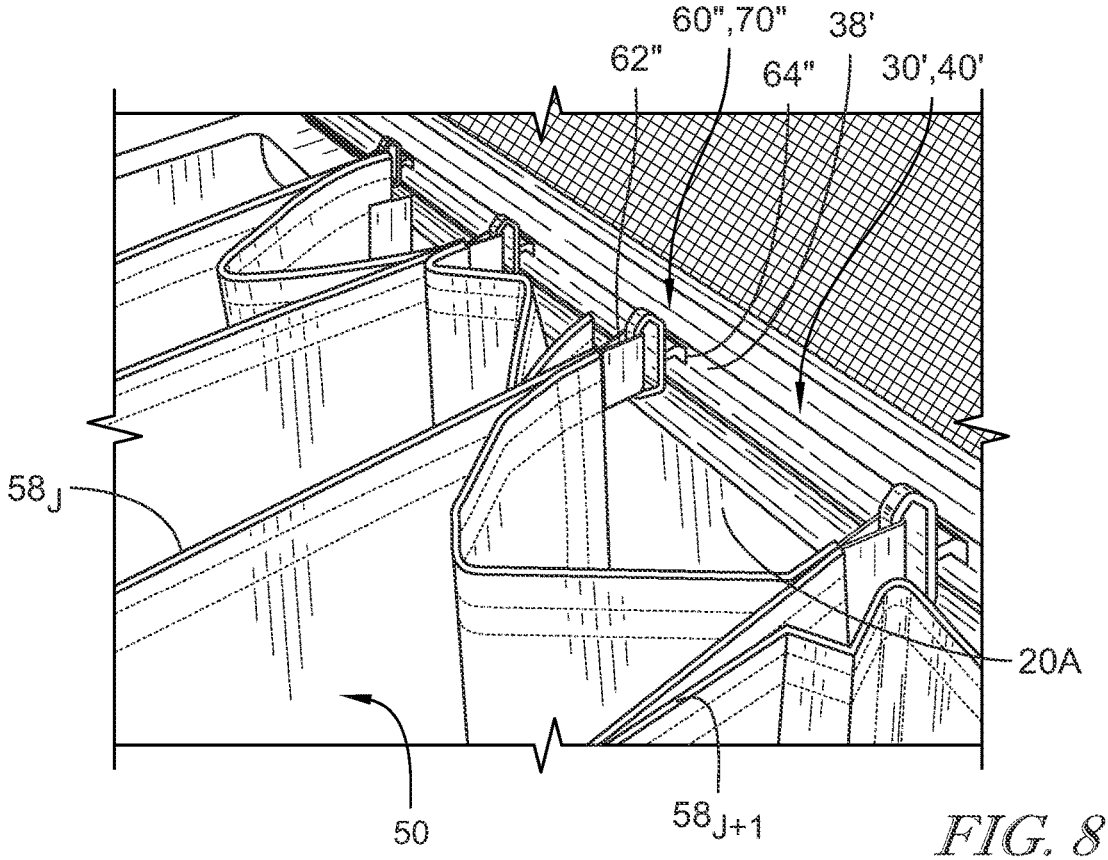
FIG. 8 is a magnified perspective view of another alternate embodiment of the cargo pouches, support members, and cargo pouch support rails mounted to the container.

Referring now to FIG. 8, a non-limiting example is shown of another embodiment of one of the support rails 30', 40' and of one of the support members 60", 70' illustrated and described above with respect to FIGS. 1-5. In the illustrated embodiment, the support rails 30', 40' (only one support rail shown in FIG. 8) are provided in the form of elongated brackets defining a channel 38' therein and extending axially along the bracket. In the embodiment illustrated in FIG. 8, the support members 60", 70" are illustratively provided in the form of clips 62" sewn or otherwise attached directly to the sides of the pouches $\mathbf{50}_1$-$\mathbf{50}_N$ at or near the tops, e.g., $\mathbf{58}_J$, $\mathbf{58}_{J+1}$, thereof, wherein each clip 62" includes a tongue 64" or similar structure configured to engage the channel 38' so as to support the cargo pouches $\mathbf{50}_1$-$\mathbf{50}_N$ on the support rails 30', 40' and to also slide or glide along the channel 38' so as to move the cargo pouches $\mathbf{50}_1$-$\mathbf{50}_N$ along the support rails 30', 40'. In such embodiments, the tongues 64" of the clips 62" are thus attached at and to opposite sides of the pouches $\mathbf{50}_1$-$\mathbf{50}_N$ at or near the tops 58 thereof, and the tongues 64" are inserted into the channels 38' of the respective support rails 30', 40' to arrange the cargo pouches $\mathbf{50}_1$-$\mathbf{50}_N$ within the container 20 as described above such that the cargo pouches $\mathbf{50}_1$-$\mathbf{50}_N$ are movable along and relative to the support rails 30', 40'.

Figure 9:
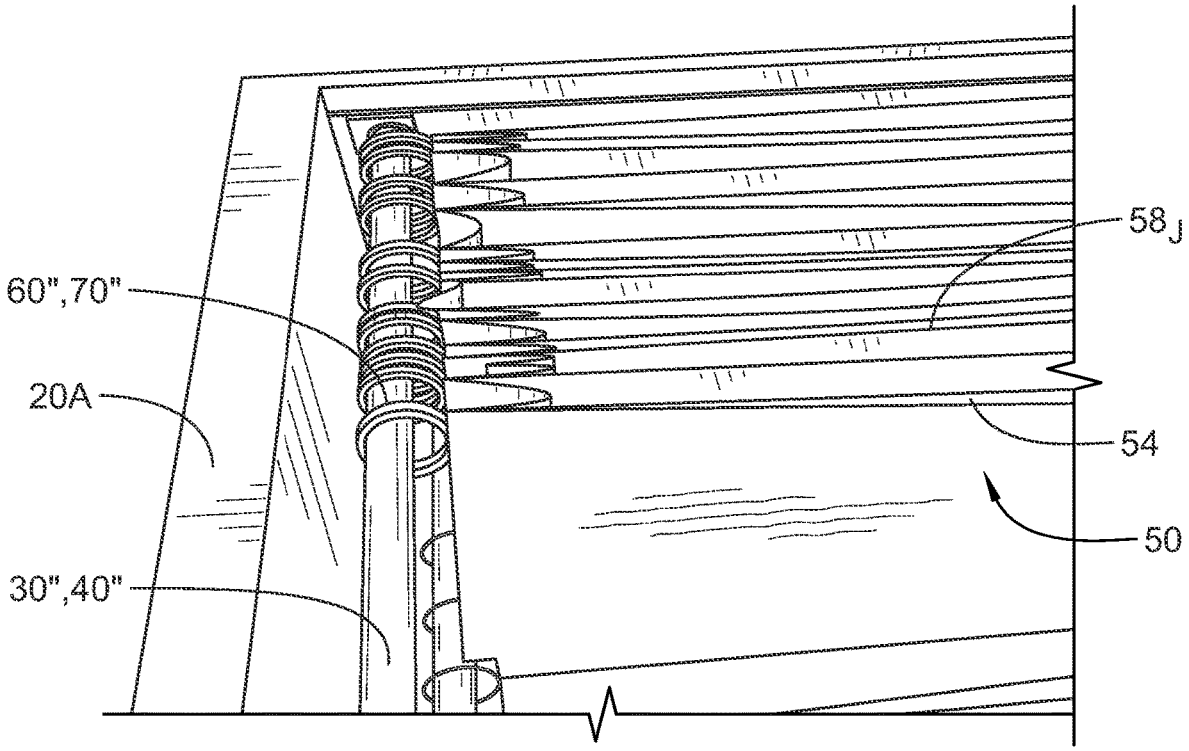
FIG. 9 is a magnified perspective view of yet another alternate embodiment of the cargo pouches, support members, and cargo pouch support rails mounted to the container.

Referring now to FIG. 9, a non-limiting example is shown of yet another embodiment of one of the support rails 30", 40" and of one of the support members 60'", 70'" illustrated and described above with respect to FIGS. 1-5. In the illustrated embodiment, the support rails 30", 40" (only one support rail shown in FIG. 9) are provided in the form of elongated tubes. In the embodiment illustrated in FIG. 9, the support members 60'", 70'" are illustratively provided in the form rings sewn or otherwise attached directly to the sides of the pouches $\mathbf{50}_1$-$\mathbf{50}_N$ at or near the tops 54, 58 thereof, wherein each ring 60'", 70'" is configured to be received on and to slide or glide along a respective one of the support rails 30", 40" so as to move the cargo pouches $\mathbf{50}_1$-$\mathbf{50}_N$ along the support rails 30", 40". In some embodiments, the rings 60'", 70'" may be closed and have any conventional shape, e.g., "O"-shaped, "D"-shaped, etc., although in other embodiments the rings 60'", 70'" may be open at the bottom so as to extend over and onto the respective support rail 30", 40".

While the disclosure has been illustrated and described in detail in the drawings and foregoing description, such an illustration and description is to be considered as exemplary and not restrictive in character, it being understood that only illustrative embodiments have been shown and described and that all changes and modifications consistent with the disclosure and recited claims are desired to be protected. For example, it will be understood that whereas several different embodiments of the support members (some including support rods) are illustrated in the drawings and described above, such embodiments are provided only by way of example and should not be considered limiting in any way. Myriad other support members (some including other support rods and others not including support rods) known in the art are contemplated by this disclosure and may be used with the concepts described herein. As another example, it will be understood that whereas the embodiment illustrated in FIGS. 1-5 is shown and described as including only a single tier of cargo pouches, alternate embodiments are contemplated which may include multiple tiers of cargo pouches, i.e., multiple tiers arranged in a container with a top tier at, adjacent to or spaced apart from, the top of the container, and with each successive tier arranged vertically below the tier above it, wherein the cargo pouches of two or more of the tiers are coupled to each side the container using two support rails, one above the other, as illustrated in the attached drawings and described above.

What is claimed is:

1. A dunnage arrangement, comprising:

a container having spaced-apart sidewalls each defining a length and each extending upwardly from opposite respective sides of a floor of the container, a first pair of guide rails each mounted to and extending at least partially along the length of a respective one of the spaced-apart sidewalls of the container, a second pair of guide rails each mounted to and extending at least partially along the length of a respective one of the spaced-apart sidewalls such that each of the second pair of guide rails is positioned between the floor and a respective one of the first pair of guide rails, a plurality of pouches each having first and second opposed sidewalls extending upwardly from a bottom wall or fold to define a pocket therebetween configured to support cargo within the container, and support members coupled to or near terminal tops of each of the first and second sidewalls of the plurality of pouches, wherein the pouches are received side-by-side within the container with the support members coupled to the first sidewalls supported on and movable along the first pair of guide rails and with the support members coupled to the second sidewalls supported on and movable along the second pair of guide rails.

2. The dunnage arrangement of claim 1, wherein the first pair of guide rails are aligned and parallel with one another with both of the first pair of guide rails disposed a first distance above the floor of the container, and wherein the second pair of guide rails are aligned and parallel with one another with both of the second pair of guide rails disposed a second distance above the floor of the container, the second distance less than the first distance by at least a thickness of the support members.

3. The dunnage arrangement of claim 2, wherein each of the first pair of guide rails and each of the second pair or guide rails comprises an elongated hollow member defining a channel extending at least partially along the length of a respective one of the spaced-apart sidewalls of the container, and wherein the support members each comprise at least one rod coupled to or near a terminal top of a respective one of the first and second sidewalls of the plurality of pouches and extending between the spaced-apart sidewalls of the container, and rollers attached to opposite ends of the at least one rod, the rollers disposed within and configured to roll or glide along the channels of a respective one of the first or second pair of guide rails.

4. The dunnage arrangement of claim 2, wherein each of the first pair of guide rails and each of the second pair or guide rails comprises an elongated hollow member defining a channel extending at least partially along the length of a respective one of the spaced-apart sidewalls of the container, and wherein the support members each comprise a pair of rollers attached to respective opposite sides a respective one of the first and second sidewalls of the plurality of pouches at or near a terminal top thereof, the rollers disposed within and configured to roll or glide along the channels of a respective one of the first or second pair of guide rails.

5. The dunnage arrangement of claim 2, wherein each of the first pair of guide rails and each of the second pair or guide rails comprises an elongated hollow member defining a channel extending at least partially along the length of a respective one of the spaced-apart sidewalls of the container, and wherein the support members each comprise at least one rod coupled to or near a terminal top of a respective one of the first and second sidewalls of the plurality of pouches and extending between the spaced-apart sidewalls of the container, the at least one rod having flared opposite ends disposed within and configured to glide along the channels of a respective one of the first or second pair of guide rails.

6. The dunnage arrangement of claim 2, wherein each of the first pair of guide rails and each of the second pair or guide rails comprises an elongated bracket defining a channel extending at least partially along the length of a respective one of the spaced-apart sidewalls of the container, and wherein the support members each comprise a pair of clips attached to respective opposite sides a respective one of the first and second sidewalls of the plurality of pouches at or near a terminal top thereof, each of the clips including an engagement member engaging the channels such that the clips slide or glide along the channels of a respective one of the first or second pair of guide rails.

7. The dunnage arrangement of claim 2, wherein each of the first pair of guide rails and each of the second pair or guide rails comprises an elongated tube extending at least partially along the length of a respective one of the spaced-apart sidewalls of the container, and wherein the support members each comprise a pair of rings attached to respective opposite sides a respective one of the first and second sidewalls of the plurality of pouches at or near a terminal top thereof, each of the rings received on a respective one of the first or second pair of guide rails such that the rings slide or glide along a respective pair of tubes.

8. The dunnage arrangement of claim 2, wherein the support members comprise:

a plurality of first support members each coupled to or near a terminal top of the first sidewall of a respective one of the plurality of pouches, and a plurality of second support members each coupled to or near a terminal top of the second sidewall of a respective one of the plurality of pouches.

9. The dunnage arrangement of claim 8, wherein each of the plurality of pouches has a folded configuration in which the first and second sidewalls of the pouch are adjacent to one another, the first support member is supported on the first pair of guide rails and the second support member is supported on the second pair of guide rails and positioned at least partially under the first support member, and wherein each of the plurality of pouches has an expanded configuration in which the support members of the respective first and second sidewalls are spaced apart from one another along the respective first and second pair of guide rails to allow cargo to be received in and withdrawn from the pocket.

10. A dunnage arrangement, comprising:

a container having spaced-apart sidewalls each defining a length and each extending upwardly from opposite respective sides of a floor of the container, a first pair of guide rails each mounted to and extending at least partially along the length of a respective one of the spaced-apart sidewalls of the container, a second pair of guide rails each mounted to and extending at least partially along the length of a respective one of the spaced-apart sidewalls such that each of the second pair of guide rails is positioned between the floor and a respective one of the first pair of guide rails, a plurality of pouches configured to be received side-by-side within the container, each having first and second opposed sidewalls extending upwardly from a bottom wall or fold to define a pocket therebetween configured to support cargo within the container, a plurality of first support members each coupled to or near a terminal top of the first sidewall of a respective one of the plurality of pouches, and a plurality of second support members each coupled to or near a terminal top of the second sidewall of a respective one of the plurality of pouches, wherein each of the plurality of pouches has a folded configuration in which the first and second sidewalls of the pouch are adjacent to one another, the first support member is supported on the first pair of guide rails and the second support member is supported on the second pair of guide rails and positioned at least partially under the first support member, and wherein each of the plurality of pouches has an expanded configuration in which the support members of the respective first and second sidewalls are spaced apart from one another along the respective first and second pair of guide rails to allow cargo to be received in and withdrawn from the pocket.

11. The dunnage arrangement of claim 10, wherein the first pair of guide rails are aligned and parallel with one another with both of the first pair of guide rails disposed a first distance above the floor of the container, and wherein the second pair of guide rails are aligned and parallel with one another with both of the second pair of guide rails disposed a second distance above the floor of the container, the second distance less than the first distance by at least a thickness of the support members.

12. The dunnage arrangement of claim 11, wherein each of the first pair of guide rails and each of the second pair or guide rails comprises an elongated hollow member defining a channel extending at least partially along the length of a respective one of the spaced-apart sidewalls of the container, and wherein the plurality of first support members and the plurality of second support members each comprise at least one rod coupled to or near a terminal top of a respective one of the first and second sidewalls of the plurality of pouches and extending between the spaced-apart sidewalls of the container, and rollers attached to opposite ends of the at least one rod, the rollers disposed within and configured to roll or glide along the channels of a respective one of the first or second pair of guide rails.

13. The dunnage arrangement of claim 11, wherein each of the first pair of guide rails and each of the second pair or guide rails comprises an elongated hollow member defining a channel extending at least partially along the length of a respective one of the spaced-apart sidewalls of the container, and wherein the plurality of first support members and the plurality of second support members each comprise a pair of rollers attached to respective opposite sides a respective one of the first and second sidewalls of the plurality of pouches at or near a terminal top thereof, the rollers disposed within and configured to roll or glide along the channels of a respective one of the first or second pair of guide rails.

14. The dunnage arrangement of claim 11, wherein each of the first pair of guide rails and each of the second pair or guide rails comprises an elongated hollow member defining a channel extending at least partially along the length of a respective one of the spaced-apart sidewalls of the container, and wherein the plurality of first support members and the plurality of second support members each comprise at least one rod coupled to or near a terminal top of a respective one of the first and second sidewalls of the plurality of pouches and extending between the spaced-apart sidewalls of the container, the at least one rod having flared opposite ends disposed within and configured to glide along the channels of a respective one of the first or second pair of guide rails.

15. The dunnage arrangement of claim 11, wherein each of the first pair of guide rails and each of the second pair or guide rails comprises an elongated bracket defining a channel extending at least partially along the length of a respective one of the spaced-apart sidewalls of the container, and wherein the plurality of first support members and the plurality of second support members each comprise a pair of clips attached to respective opposite sides a respective one of the first and second sidewalls of the plurality of pouches at or near a terminal top thereof, each of the clips including an engagement member engaging the channels such that the clips slide or glide along the channels of a respective one of the first or second pair of guide rails.

16. The dunnage arrangement of claim 11, wherein each of the first pair of guide rails and each of the second pair or guide rails comprises an elongated tube extending at least partially along the length of a respective one of the spaced-apart sidewalls of the container, and wherein the plurality of first support members and the plurality of second support members each comprise a pair of rings attached to respective opposite sides a respective one of the first and second sidewalls of the plurality of pouches at or near a terminal top thereof, each of the rings received on a respective one of the first or second pair of guide rails such that the rings slide or glide along a respective pair of tubes.

17. A dunnage arrangement, comprising:

a container having spaced-apart sidewalls each defining a length and each extending upwardly from opposite respective sides of a floor of the container, a first pair of guide rails each mounted to and extending at least partially along the length of a respective one of the spaced-apart sidewalls of the container, a second pair of guide rails each mounted to and extending at least partially along the length of a respective one of the spaced-apart sidewalls such that each of the second pair of guide rails is positioned between the floor and a respective one of the first pair of guide rails, a plurality of pouches configured to be received side-by-side within the container, each having first and second opposed sidewalls extending upwardly from a bottom wall or fold to define a pocket therebetween for supporting cargo within the container, and support members, coupled to the plurality of pouches, supported on and movable along each of the first and second pairs of guide rails, wherein the first sidewall of each of the plurality of pouches defines a first length between the bottom wall or fold and a respective one of the support members coupled thereto and supported on the first pair of guide rails, and wherein the second sidewall of each of the plurality of pouches defines a second length between the bottom wall or fold and a respective one of the support members coupled thereto and supported on the second pair of guide rails, the second length less than the first length.

18. The dunnage arrangement of claim 17, wherein both of the first pair of guide rails are aligned and parallel with one another with both of the first pair of guide rails disposed a first distance above the floor of the container, and wherein both of the second pair of guide rails are aligned and parallel with one another with both of the second pair of guide rails disposed a second distance above the floor of the container, the second distance and the second length less than the first distance and the first length respectively by at least a thickness of the support members.

19. The dunnage arrangement of claim 18, wherein the support members comprise:

a plurality of first support members each coupled to or near a terminal top of the first sidewall of a respective one of the plurality of pouches, and a plurality of second support members each coupled to or near a terminal top of the second sidewall of a respective one of the plurality of pouches.

20. The dunnage arrangement of claim 19, wherein each of the plurality of pouches has a folded configuration in which the first and second sidewalls of the pouch are adjacent to one another, the first support member is supported on the first pair of guide rails and the second support member is supported on the second pair of guide rails and positioned at least partially under the first support member, and wherein each of the plurality of pouches has an expanded configuration in which the support members of the respective first and second sidewalls are spaced apart from one another along the respective first and second pair of guide rails to allow cargo to be received in and withdrawn from the pocket.

* * * * *